US006219515B1

(12) United States Patent
Lestrange

(10) Patent No.: US 6,219,515 B1
(45) Date of Patent: Apr. 17, 2001

(54) VIBRATING TRAVEL WAVE GRID

(75) Inventor: Jack T. Lestrange, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/466,052

(22) Filed: Dec. 17, 1999

(51) Int. Cl.[7] ..... G03G 15/08
(52) U.S. Cl. ..... 399/289; 399/285
(58) Field of Search ..... 399/289, 285, 399/265, 266, 290, 291, 294, 295, 55

(56) References Cited

U.S. PATENT DOCUMENTS

| | | | | |
|---|---|---|---|---|
| 4,647,179 | | 3/1987 | Schmidlin | 355/3 DD |
| 4,794,878 | * | 1/1989 | Connors et al. | 399/265 |
| 5,414,497 | * | 5/1995 | Tsuchiya et al. | 399/272 |
| 5,761,591 | | 6/1998 | Yamaguchi | 399/289 |

FOREIGN PATENT DOCUMENTS

| | | | |
|---|---|---|---|
| 61-073167 | * | 4/1986 | (JP) . |
| 62-095564 | * | 5/1987 | (JP) . |
| 62-095565 | * | 5/1987 | (JP) . |

* cited by examiner

*Primary Examiner*—Robert Beatty
(74) *Attorney, Agent, or Firm*—Lloyd F. Bean, II

(57) ABSTRACT

An apparatus for developing a latent image recorded on an imaging surface, including a housing defining a chamber for storing a supply of developer material comprising toner; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; first and second discrete vibrating members in contact with said donor member, for applying first and second discrete high frequency vibratory energy to said donor member; a multi-phase voltage source operatively coupled to said electrode array and said vibrating members, wherein the phase of said multi-phase voltage source being shifted with respect to each other such as to create an electrodynamic wave pattern for moving toner particles along said electrode array and driving said vibrating members.

8 Claims, 4 Drawing Sheets

VIBRATING TRAVEL WAVE GRID

FIELD OF THE INVENTION

This invention relates generally to a development apparatus for ionographic or electrophotographic imaging and printing apparatuses and machines, and more particularly is directed to a vibrating traveling wave grid for developing a latent electrostatic image.

BACKGROUND OF THE INVENTION

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner (i.e. charged pigment) to the latent images without creating large adhesive forces between the toner and the conveyor which transport the toner to latent images. As will be appreciated, large fluctuation (i.e. noise) in the adhesive forces that cause the pigment to tenaciously adhere to the carrier severely limit the sensitivity of the developer system thereby necessitating higher contrast voltages forming the images. Accordingly, it is desirable to reduce such noise particularly in connection with latent images formed by contrasting voltages.

In order to minimize the creation of such fluctuation in adhesive forces, there is provided, in the preferred embodiment of the invention a toner conveyor including means for generating traveling electrostatic waves which can move the toner about the surface of the conveyor with minimal contact therewith.

Traveling waves have been employed for transporting toner particles in a development system, for example U.S. Pat. No. 4,647,179 to Schmidlin which is hereby incorporated by reference. In that patent, the traveling wave is generated by alternating voltages of three or more phases applied to a linear array of conductors placed abut the outer periphery of the conveyor. The force F for moving the toner about the conveyor is equal QE t where Q is the charge on the toner and E t is the tangential field supplied by a multi-phase AC voltage applied to the array of conductors.

Traveling wave devices have been proposed for a number of years to transport, separate and deliver charged particles to a latent electrostatic image. Some of the reasons this is an attractive approach include absence of moving parts, control of the toner position , very long and stable development zones, and architectural flexibility. A semiconductive overcoat may be desirable on the grid providing a smooth surface for the toner motion and also a possible charge relaxation channel. Various modes of charged particle transport are possible. The so-called synchronous modes of the electrostatic travel wave transport have been found and indicated as appropriate to facilitate the toner transport that can be used for xerographic development systems.

In those modes, the toner particles move along the carrying surface with the traveling wave phase velocity $V_{ph}=\omega/k$ where $\omega$ and k are the frequency and the wavevector of the wave respectively. This velocity is achieved through the action of the longitudinal (x) component of the electrostatic force while the average normal (z) component of the force on the average contains the toners near the carrying surface. The toner particles therefore turn out to be in constant intimate contact with the surface which sometimes causes toner to pile up in region on the surface, preventing toner from moving past that region to the development zone.

SUMMARY OF THE INVENTION

Briefly, the present invention obviates the problems noted above by utilizing an apparatus for developing a latent image recorded on an imaging surface, including a housing defining a chamber for storing a supply of developer material comprising toner; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; a vibrating member, in contact with said donor member, for applying the high frequency vibratory energy to said donor member; a multi-phase voltage source operatively coupled to said electrode array and said vibrating member, wherein the phase of said multi-phase voltage source being shifted with respect to each other such as to create an electrodynamic wave pattern for moving toner particles along said electrode array and driving said vibrating member.

Inasmuch as the art of electrophotographic printing is well known, the various processing stations employed in the printing machine will be shown hereinafter schematically and their operation described briefly with reference thereto.

DETAILED DESCRIPTION OF THE INVENTION

Figure 1:
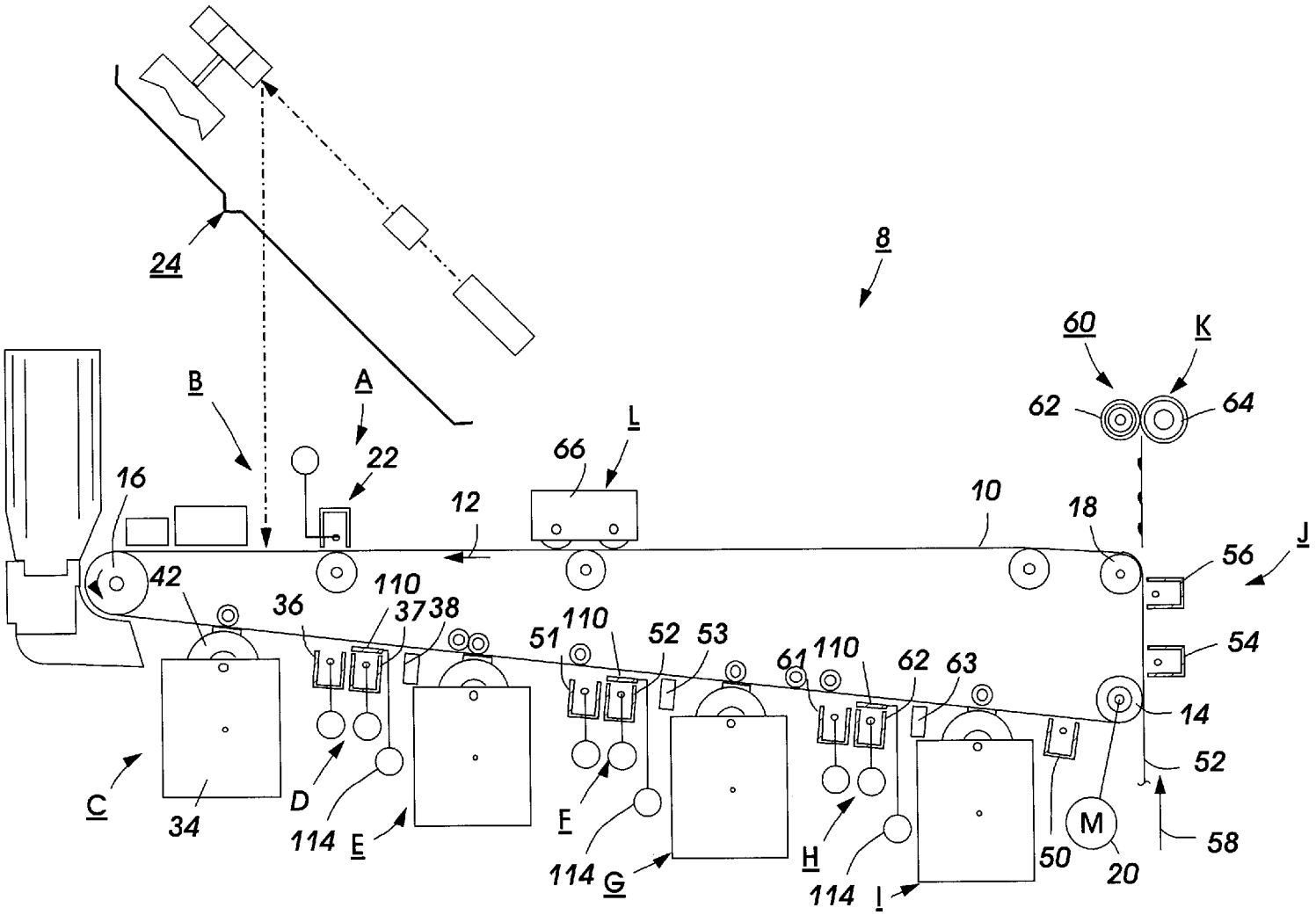
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention After passing through the first exposure station B, the now exposed image area passes through a first development station C which is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

For the first development station C, development system 34 includes a flexible donor belt 42 having groups of electrode arrays near the surface of the belt which develops the image with toner.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged by the first recharging device 36, the image area passes to the second recharging device 37. After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the back-side of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 2:
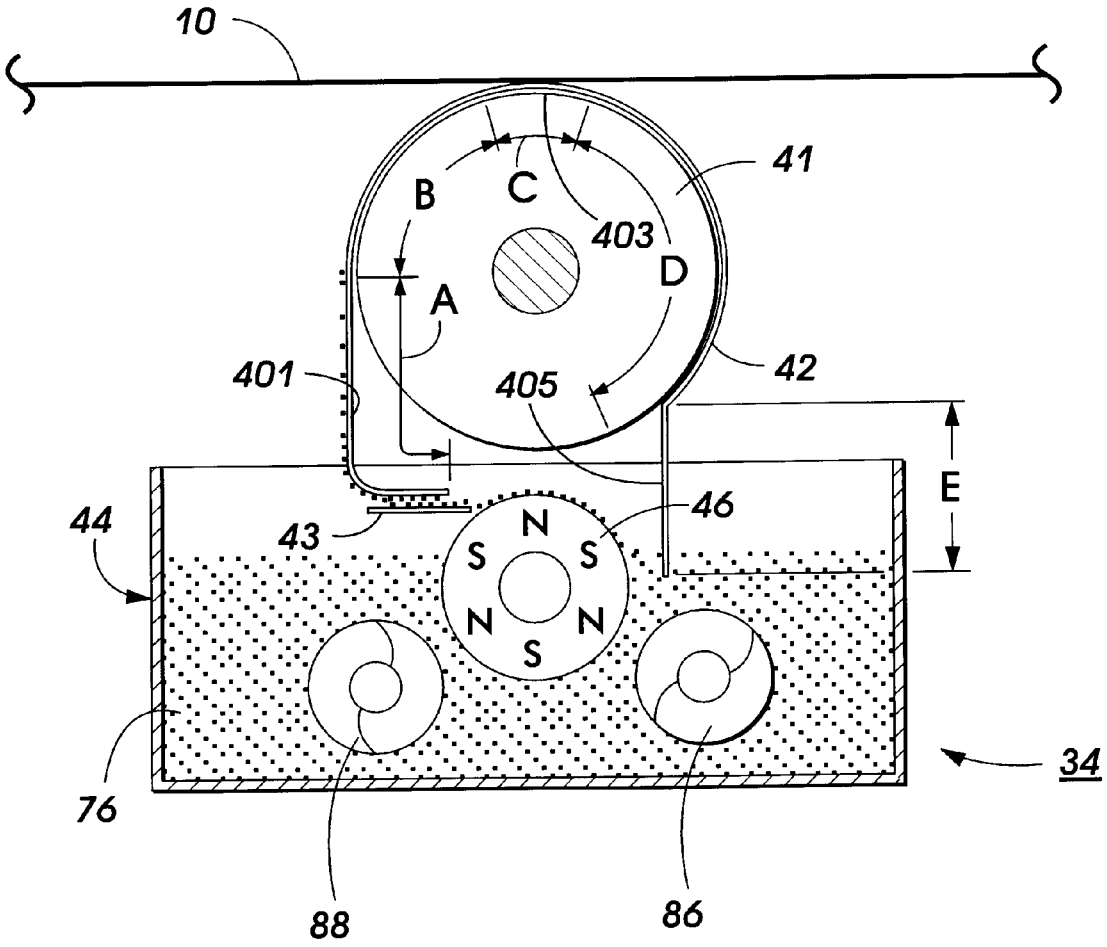
FIG. 2 is a schematic elevational view showing the development apparatus used in the FIG. 1 printing machine.
Figure 3:
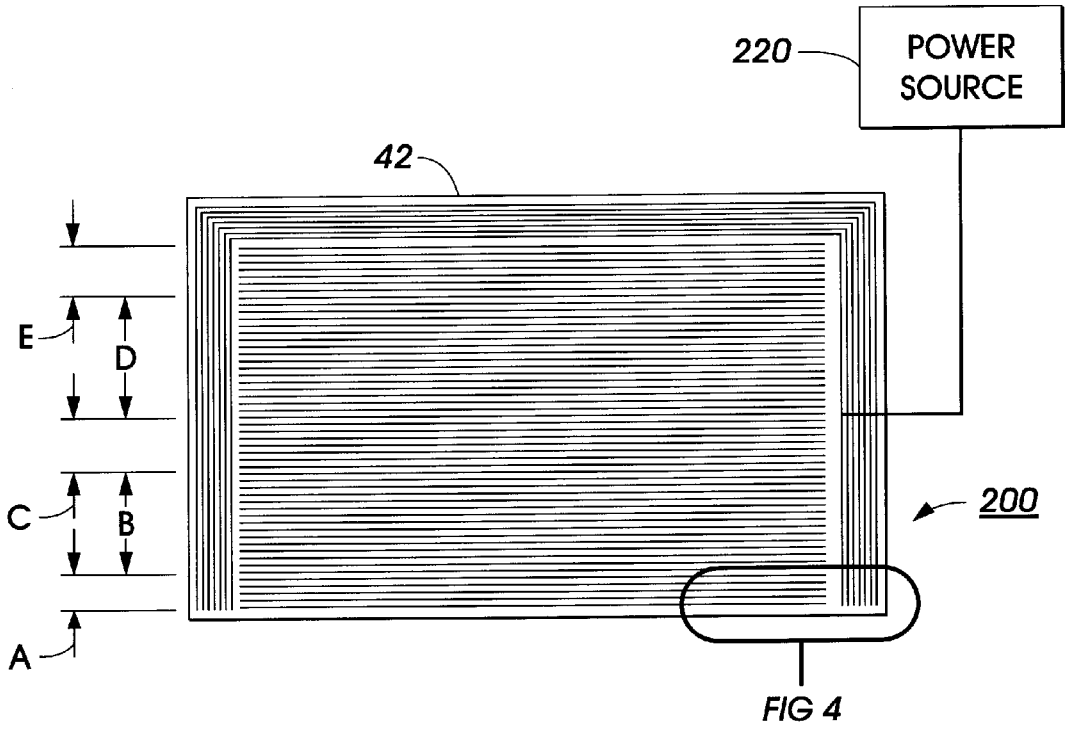
FIGS. 3 and 4 are top view of a portion of the flexible donor belt of the present invention.
Figure 4:
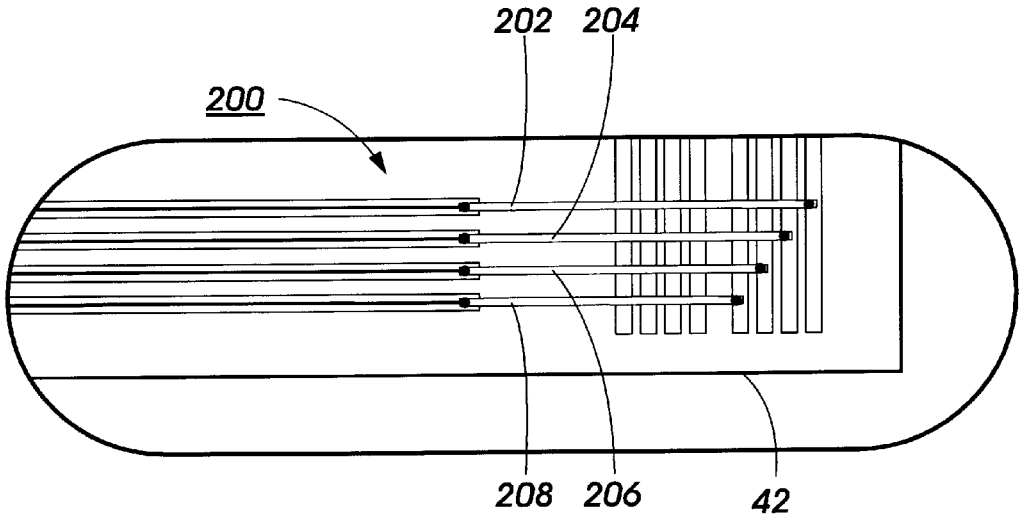

Turning to FIGS. 2, which illustrates the development system 34 in greater detail, development system 34 includes a housing 44 defining a chamber 76 for storing a supply of developer material therein. Donor belt 42 is mounted on stationary roll 41 and belt portion 43 is mounted adjacent to magnetic roll 46. Donor belts 42 comprise a flexible circuit board having finely spaced electrode array 200 thereon as shown in FIGS. 3 and 4. The typical spacing between electrodes is between 75 and 100 microns. The electrode array 200 has a four phase grid structure consisting of electrodes 202, 204, 206 and 208 having a voltage source and a wave generator 300 operatively connected thereto in the manner shown in order to supply the proper wave form in the appropriate electrode area groups A–E.

Electrode array 200 has group areas A–E in which each group area is individually addressable to perform the function of: (A) Loading toner onto the array from the housing; (B)Transferring toner to the development zone; (C) Developing the image in the development zone; (D) Transferring toner from the development zone and (E) Unloading toner from the array back into the housing. Each electrode array group area is independently addressable and operatively connected to voltage source 220 and wave generator 300. The electrodes in array group area (A) picks up the toner from the housing and transports it via the electrostatic wave set up by wave generator 300. Electrode array group areas A–E connected to the voltage source via wave generator 300 develops a traveling wave pattern is established. The electrostatic field forming the traveling wave pattern pushes the toner particles about the surface of the donor belt from the developer sump 76 to the belt 10 where they are transferred to the latent electrostatic images on the belt 10. Thereafter, the remaining (untransferred) toner is moved by electrode array group area D to electrode group area E where remaining toner is unloaded off the belt.

Figure 5:
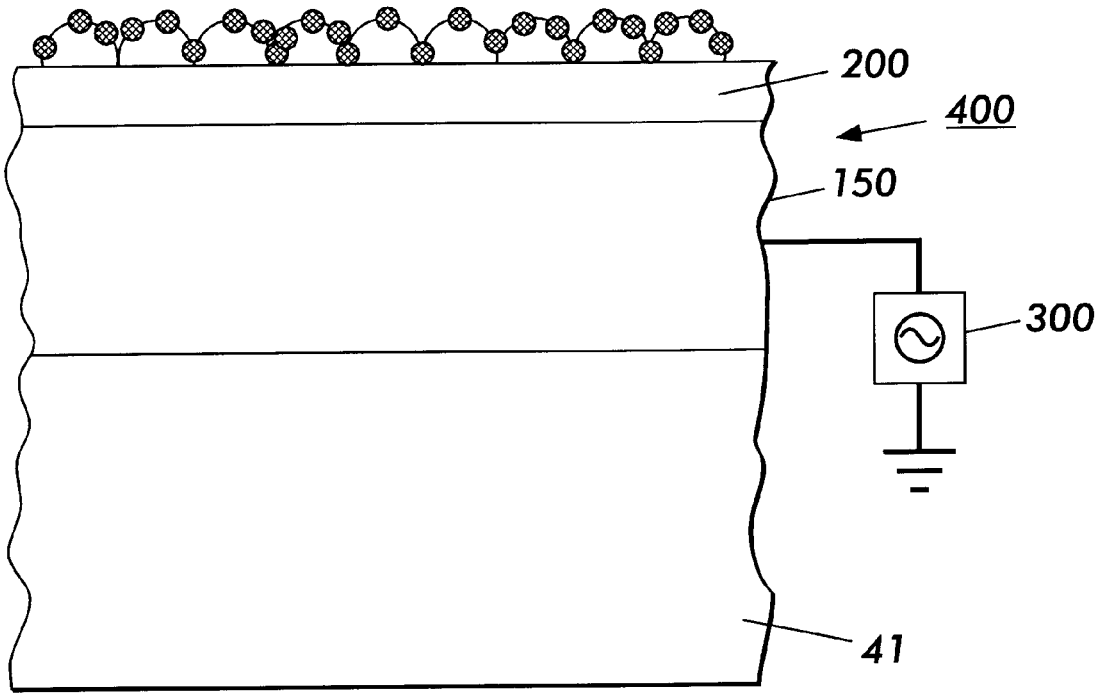
FIG. 5 is partial side view of a portion of the flexible donor belt of the present invention.

With reference to FIG. 5, the vibratory energy of the resonator 400 may be coupled to electrode array 200 in a number of ways such as deposited onto or bonded onto electrode array 200. In the arrangements shown, resonator 400 comprises piezoelectric transducer element 150. The piezoelectric transducer element 150 is deposited onto electrode array 200. The piezoelectric transducer element 150 comprises a piezoelectric active polymer, such as polyvinylidene fluoride (PVDF). Alternatively, other materials, might include copolymers of vinylidene fluoride and trifluoroethylene (P(VDF/TrFe)) or vinylidene fluoride and tetrafluoroethylene P(VDF/TeFe), or composite materials comprising a piezoelectric active ceramic particulate material in a polymeric binder. Piezoelectric active ceramic materials may include for example, barium titanate BaTiO, lead zirconate titanate (PZT), or lead titanate PbTiO. The binder polymer may include PVDF, epoxies, or any of a variety of polymer resins to provide an appropriate composite structure which may be directly deposited onto the electrode array 200 surface. Properties of the piezoelectric polymer constituents may be selected to provide optimal displacement and coupling to the electrode array 200 based upon the piezoelectric constant and elastic moduli. Resonator 400 is driven by a voltage source and a wave generator 300 operated at a frequency f between 20 kHz and 200 kHz, is arranged in vibrating relationship with back side of electrode array 200.

The present invention uses a vibrating energy in order to decrease the intimate contact of the toner particles with the carrying surface while still sustaining the motion along the surface with the average velocity vph.

Being constantly shaken toner particles can spend some time in the air jumping from the surface and returning back, and in general the probability of sticking to the surface should decrease which will improve sustained toner motion on the wave. At the same time, in the development zone, this would render the toner more susceptible to the development fields. The travelling cloud height would be more controllable than when it is caused by the random surface scattering.

In alternative embodiment of the present invention, multiple resonators can be attached to array 200 which are associated with electrode area groups A–F. For example in the loading area (A), a minimum amount of vibrational energy can be applied by resonator 401, in the development zone (C) a different amount of vibrational energy can be applied by resonator 403 to facilitate the toner being susceptible to the development fields, and in the unloading area (E) a high amount of vibrational energy can be applied by resonator 405 to facilitate toner removal.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber for storing a supply of developer material comprising toner;

a donor member, spaced from the imaging surface, for transporting toner on the surface thereof to a region opposed from the imaging surface, said donor member includes an electrode array on the outer surface thereof, said array including a plurality of spaced apart electrodes extending substantial across the width of the surface of the donor member;

a vibrating member, in contact with said donor member, for applying the high frequency vibratory energy to said donor member, said vibrating member comprises a first discrete vibrating member associated with a first region of said donor member and a second discrete vibrating member associated with a second region of said donor member, said first discrete vibrating member applies a first discrete level of high frequency vibratory energy to said first region of said donor member and said second discrete vibrating member applies a second discrete level of high frequency vibratory energy to said second region of said donor member;

a multi-phase voltage source operatively coupled to said electrode array and said vibrating member, wherein the phase of said multi-phase voltage source being shifted with respect to each other such as to create an electrodynamic wave pattern for moving toner particles along said electrode array and driving said vibrating member.

2. The apparatus of claim 1, wherein said vibrating member is attached to said donor member.

3. The apparatus of claim 1, wherein said vibrating member comprises a piezoelectric polymer member.

4. The apparatus of claim 3, further comprising a voltage source, coupled to said piezoelectric polymer member, to excite said piezoelectric polymer member to generate the high frequency vibratory energy required to drive said donor member.

5. An electrophotographic printing machine wherein an electrostatic latent image is recorded on an imaging surface of a photoconductive member developed with toner, comprising;

a housing defining a chamber for storing a supply of developer material comprising toner;

a donor member, spaced from the imaging surface, for transporting toner on the surface thereof to a region opposed from the imaging surface, said donor member includes an electrode array on the outer surface thereof, said array including a plurality of spaced apart electrodes extending substantial across the width of the surface of the donor member;

a vibrating member, in contact with said donor member, for applying the high frequency vibratory energy to said donor member, said vibrating member comprises a first discrete vibrating member associated with a first region of said donor member and a second discrete vibrating member associated with a second region of said donor member, said first discrete vibrating member applies a first discrete level of high frequency vibratory energy to said first region of said donor member and said second discrete vibrating member applies a second discrete level of high frequency vibratory energy to said second region of said donor member;

a multi-phase voltage source operatively coupled to said electrode array and said vibrating member, wherein the phase of said multi-phase voltage source being shifted with respect to each other such as to create an electrodynamic wave pattern for moving toner particles along said electrode array and driving said vibrating member.

6. The electrophotographic printing machine of claim 5, wherein said vibrating member is attached to said donor member.

7. The electrophotographic printing machine of claim 5, wherein said vibrating member comprises a piezoelectric polymer member.

8. The electrophotographic printing machine of claim 7, further comprising a voltage source, coupled to said piezoelectric polymer member, to excite said piezoelectric polymer member to generate the high frequency vibratory energy required to drive said donor member.

* * * * *